US009174440B2

(12) United States Patent
Kladias et al.

(10) Patent No.: US 9,174,440 B2
(45) Date of Patent: Nov. 3, 2015

(54) INDEPENDENT ADJUSTMENT OF DROP MASS AND DROP SPEED USING NOZZLE DIAMETER AND TAPER ANGLE

(75) Inventors: Nicholas P. Kladias, Flushing, NY (US); John R. Andrews, Fairport, NY (US); Gerald A. Domoto, Briarcliff Manor, NY (US); Peter M. Gulvin, Webster, NY (US); Peter J. Nystrom, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 1203 days.

(21) Appl. No.: 12/425,651

(22) Filed: Apr. 17, 2009

(65) Prior Publication Data

US 2010/0265296 A1 Oct. 21, 2010

(51) Int. Cl.
*B41J 2/14* (2006.01)

(52) U.S. Cl.
CPC ..... *B41J 2/14201* (2013.01); *B41J 2/1433* (2013.01); *B41J 2002/14475* (2013.01)

(58) Field of Classification Search
USPC ..... 347/44–47, 68, 70
See application file for complete search history.

(56) References Cited

U.S. PATENT DOCUMENTS

| | | | | |
|---|---|---|---|---|
| 6,412,926 | B1 * | 7/2002 | Okuda | 347/70 |
| 8,646,875 | B2 * | 2/2014 | Gulvin et al. | 347/47 |
| 2004/0080574 | A1 * | 4/2004 | Masumi | 347/47 |
| 2004/0113979 | A1 * | 6/2004 | Takashima et al. | 347/47 |
| 2007/0195120 | A1 * | 8/2007 | Kim et al. | 347/19 |
| 2010/0053270 | A1 * | 3/2010 | Xu et al. | 347/47 |

FOREIGN PATENT DOCUMENTS

| | | | |
|---|---|---|---|
| JP | 2000-280481 | A | 10/2000 |
| JP | 2005305883 | A * | 11/2005 |

OTHER PUBLICATIONS

English Translation of Notice of Reasons for Rejection (Office Action) dated Feb. 4, 2014, Japanese Application No. 2010-094843 filed Apr. 16, 2010, pp. 1-3.

* cited by examiner

*Primary Examiner* — Daniel Petkovsek
(74) *Attorney, Agent, or Firm* — MH2 Technology Law Group LLP

(57) ABSTRACT

Methods and systems of ejecting ink drops from an inkjet printer are disclosed. The methods and systems can include a printhead with one or more tapered nozzles each with an associated taper angle and exit diameter. Ink can be received into the printhead and formed into ink drops in the tapered nozzles. The ink drops can each have an associated drop mass and drop speed. The tapered nozzles can be provided such that the exit diameter can independently dictate the drop mass and the taper angle can independently dictate the drop speed. As such, the complexity of jet design optimization is reduced.

8 Claims, 6 Drawing Sheets

INDEPENDENT ADJUSTMENT OF DROP MASS AND DROP SPEED USING NOZZLE DIAMETER AND TAPER ANGLE

FIELD OF THE INVENTION

The present invention generally relates to independent adjustment of ink drop mass and ink drop speed using the nozzle diameter and taper angle of a tapered nozzle in an inkjet printhead.

BACKGROUND OF THE INVENTION

In a conventional inkjet printer, a printhead has a series of droplet apertures or nozzles out of which the printing fluid or ink ejects to an image receiving substrate. Each nozzle can have a corresponding actuator for ejecting the ink through the nozzle. The ink drop mass, or size, and drop speed, or velocity, can influence the quality of the printing. For example, the drop mass and speed can affect drop placement and satellite formation. In inkjet printers with a constant diameter (cylindrical) nozzle, both the ejected ink drop mass and drop speed are dependent on the nozzle diameter. For example, an increase in nozzle diameter increases both the drop mass and drop speed of the ejected ink. As such, complicated design optimizations are undertaken to attempt to obtain an acceptable drop speed in conjunction with a desired drop mass.

As are known in the art, conventional tapered, or conical, nozzles can be used instead of cylindrical nozzles. The exit diameter of the conventional tapered nozzle, or the point at which the ink drop exits the nozzle, can be used to adjust drop mass. Further, the conventional tapered nozzle can increase drop speed and improve alignment tolerances. However, conventional tapered nozzle designs cannot maintain independent control of both the drop mass and the drop speed.

Thus, there is a need for a tapered nozzle design which can control the ink drop mass independently of the drop speed and reduce the need for complicated design optimizations.

SUMMARY OF THE INVENTION

In accordance with the present teachings, an inkjet printing system is provided. The system comprises a printhead configured to receive ink and at least one tapered nozzle, wherein the at least one tapered nozzle comprises an exit diameter configured to control a mass of an ejected ink drop, and a taper angle configured to control a speed of the ejected ink drop independently from the mass of the ejected ink drop.

In accordance with the present teachings, an inkjet printhead system is provided. The system comprises a printhead comprising at least one tapered nozzle, wherein the at least one tapered nozzle comprises an exit diameter configured to control a mass of an ink drop, wherein the exit diameter is in a range of about 10 μm to about 45 μm, and a taper angle configured to control a speed of the ink drop independently from the mass of the ink drop, wherein the taper angle is in a range of about 15° to about 45°.

In accordance with the present teachings, a method for forming a printhead nozzle is provided. The method comprises providing a printhead comprising at least one tapered nozzle configured to eject an ink drop from the printhead. Further, the method comprises setting an exit diameter of the at least one tapered nozzle to dictate a mass of the ejected ink drop. Still further, the method comprises setting a taper angle of the at least one tapered nozzle to dictate a speed of the ejected ink drop independent from the mass of the ejected ink drop It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Figure 1:
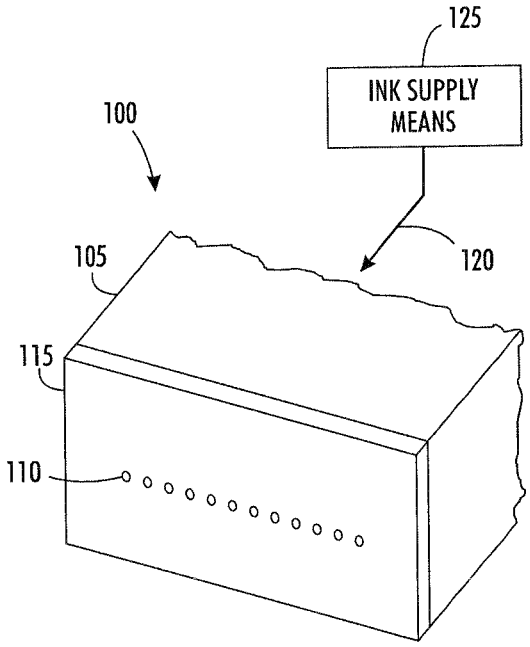
FIG. 1 depicts an exemplary ink delivery system of an inkjet printer according to the present teachings.

Reference will now be made in detail to the exemplary embodiments of the invention, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

It should be appreciated that the exemplary systems and methods depicted in FIGS. 1-7 can be employed for any inkjet printer where ink is delivered through a nozzle or aperture to an image receiving substrate, for example for piezo inkjet and solid ink systems as known in the art. The ink can be delivered through a printhead or a similar component. The exemplary systems and methods describe a tapered nozzle with distinct dimensions to control ink drop mass independent from ink drop speed.

The exemplary systems and methods can have a printhead comprising at least one tapered nozzle through which the ink can exit the printhead. The tapered nozzle can have the apex of the taper in the direction of the ink jetting, or ejecting. The dimensions of the tapered nozzle can be designed such that the drop mass and the drop speed of the ejected ink can be adjusted independently. Specifically, the tapered nozzle can have an exit with an associated exit diameter, an inside opening with an associated inside diameter, and a taper angle corresponding to the difference between the exit diameter, inside diameter, and a thickness of the nozzle. The exit diameter can be adjusted to control the drop mass of the ejected ink drops, and the taper angle can be adjusted to control the drop speed of the ejected drops. Further, the exit diameter and taper angle can respectively control the drop mass and the drop speed of the ejected ink drops independently of each other.

The independent control of the drop mass and drop speed described by the present systems and methods can reduce the complexity of single jet design optimization in a global design space while still realizing optimal drop mass and drop speed measurements. For example, the present methods and systems can employ taper angles of about 15-45° that can permit adjustment of the drop speed in the range of about 4-10 meters/second (m/s). Further, for example, the present methods and systems can employ exit diameters in the range of about 15-45 μm that can permit adjustment of the drop mass in the range of about 5-25 picoliter (pL). It should be appreciated that other ranges of taper angles and exit diameters can respectively permit adjustment of drop speed and drop mass in other ranges depending on the inkjet printer, the printhead, the type and properties of the ink used, the comprising materials, and other factors.

FIG. 1 depicts an exemplary ink delivery system of an inkjet printer. The system can include a printhead 100 with a main body 105 having a plurality of ink carrying channels (not shown in FIG. 1). In various embodiments, the plurality of ink carrying channels can be cylindrical and can run parallel to each other. The plurality of ink carrying channels can receive ink from an ink supply 125, which can provide ink through the plurality of ink carrying channels in the direction indicated by 120. The ink from the ink supply 125 can be any ink capable of being used in an inkjet printer. For example, the ink can have a viscosity of approximately 10 centipoise (cP), or other ranges and values.

The printhead 100 can further include a cover plate 115 connected to an end of the main body 105. The cover plate 115 can have a plurality of nozzles 110 extending therethrough. The cover plate 115 can be connected to the main body 105 such that each of the plurality of nozzles 110 can be in line and in connection with a corresponding ink carrying channel. As such, the ink from the ink carrying channels can be carried from the ink supply 125 and be ejected through the corresponding nozzles of the plurality of nozzles 110. It should be appreciated that the printhead 100 and the respective components of the printhead 100 can vary in size and functionality. For example, the ink can be received, transported, and ejected via other various components and methods.

Figure 2:
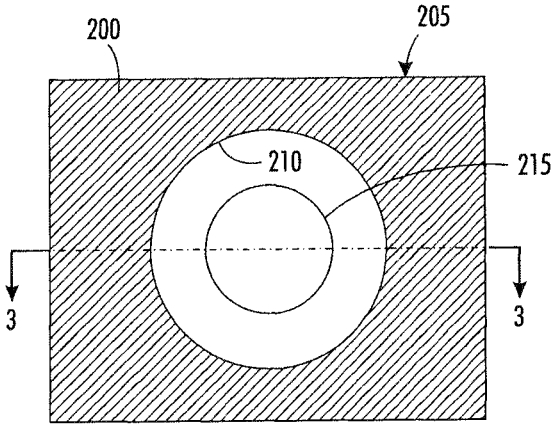
FIG. 2 depicts an exemplary tapered nozzle of a printhead according to the present teachings.

Referring to FIG. 2, depicted is an exemplary tapered nozzle of a printhead according to various embodiments. A surface 200 depicted in FIG. 2 can be an inside surface of a cover plate 205. For example, the surface 200 can be the surface where, as shown in FIG. 1, the main body 105 of the printhead 100 connects to the cover plate 115 of the printhead 100. In various embodiments, the surface 200 can correspond to a surface of any component in a printer configured to house one or more nozzles, apertures, and the like.

The cover plate 205 can include an inside opening 210 and an exit opening 215. As shown in FIG. 2, the inside opening 210 is co-planar with the surface 200. The exit opening 215 is smaller than the inside opening 210 such that a tapered, or conical, nozzle is formed through the surface 200. In various embodiments, ink can flow into the inside opening 210 and exit through the exit opening 215. For example, ink can enter the inside opening 210 from an ink carrying channel and can exit the exit opening 215 as a sequence of one or more drops after the ink is pushed through the tapered nozzle. The inside opening 210, the exit opening 215, and the tapered nozzle can be formed via conventional methods known in the art.

Figure 3:
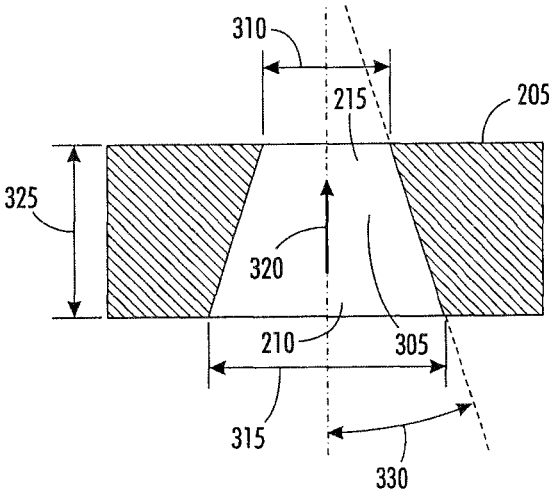
FIG. 3 depicts a partial cross section view taken along lines 3-3 illustrating an exemplary tapered nozzle according to the present teachings.

Referring to FIG. 3, depicted is a partial cross section view taken along lines 3-3 of FIG. 2 and illustrating an exemplary tapered nozzle. FIG. 3 depicts the cover plate 205, the inside opening 210, and the exit opening 215 as depicted in FIG. 2 and described in embodiments contained herein. FIG. 3 also depicts a tapered nozzle 305 that can be an aperture, orifice, passageway, or other opening that can pass through the cover plate 205 and extend from the inside opening 210 to the exit opening 215. As described herein, the ink can flow from a corresponding ink carrying channel through the nozzle 305 in the direction of 320. The exit opening 215 can be smaller than the inside opening 210 such that the apex of the tapered nozzle 305 can be at the exit opening 215. Although FIG. 3 depicts a straight line connecting the inside opening 210 with the outside opening 215, it should be appreciated that the nozzle can employ different shapes and formations. For example, the nozzle can comprise a curvature to the walls of the nozzle within the cover plate 205. The taper angle of the nozzle can be computed from the direct distance between the inside opening 205 and the outside opening 215.

The exit opening 215 can have an exit diameter 310 corresponding to the diameter of the exit opening 215. Likewise, the inside opening 210 can have an inside diameter 315 corresponding to the diameter of the inside opening 210. For example, the exit diameter can have a range of about 10-45 μm, and the inside diameter can have a range of about 25-120 μm. The cover plate 205 can have a thickness 325 where, for example, the thickness 325 can have a range of about 10-60 μm. It should; however, be appreciated that the exit diameter 310, the inside diameter 315, and the thickness 325 can each have a different range of values. For example, the exit diameter 310, the inside diameter 315, and the thickness 325 can each vary depending on the cover plate 205, the printhead, the printer, the comprising materials, the type of ink used, and other factors.

FIG. 3 further depicts a taper angle 330 corresponding to the degree of which the nozzle 305 angles, or tapers The taper angle 330 can depend on the relations among the exit diameter 310, the inside diameter 315, and/or the thickness 325. For example, when the thickness 325 is fixed, the taper angle 330 can get larger as the difference between the exit diameter 310 and the inside diameter 315 is increased. Likewise, when the thickness 325 is fixed, the taper angle 330 can get smaller as the difference between the exit diameter 310 and the inside diameter 315 is decreased. In various embodiments, the taper angle 330 can, for example, be in the range of about 15-45°.

The different values and adjustments among the exit diameter 310, the inside diameter 315, the thickness 325, and the taper angle 330 can influence the drop mass and drop speed of the ink drops that can exit the nozzle 305. Further, the different values and adjustments among the exit diameter 310, the inside diameter 315, the thickness 325, and the taper angle 330 can allow for the drop mass and drop speed to be independently dictated by the exit diameter 310 and the taper angle 330, respectively.

Figure 4A:
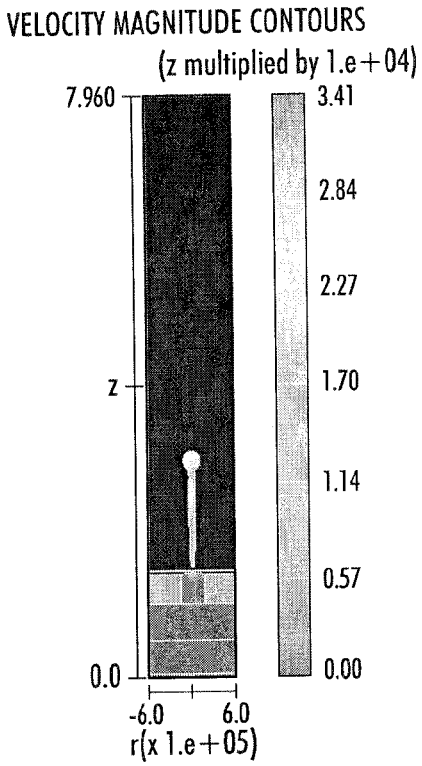
FIG. 4*a* is a graph depicting the mass and speed of an ink drop ejecting from a cylindrical nozzle according to the present teachings.
Figure 4B:
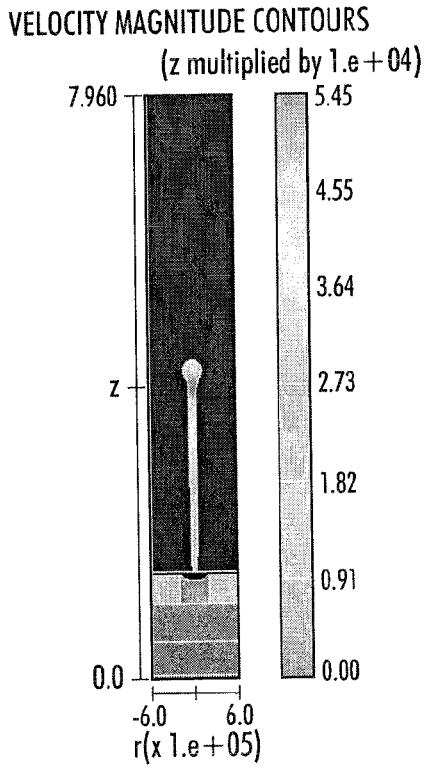
FIG. 4*b* is a graph depicting the mass and speed of an ink drop ejecting from a cylindrical nozzle according to the present teachings.
Figure 5A:
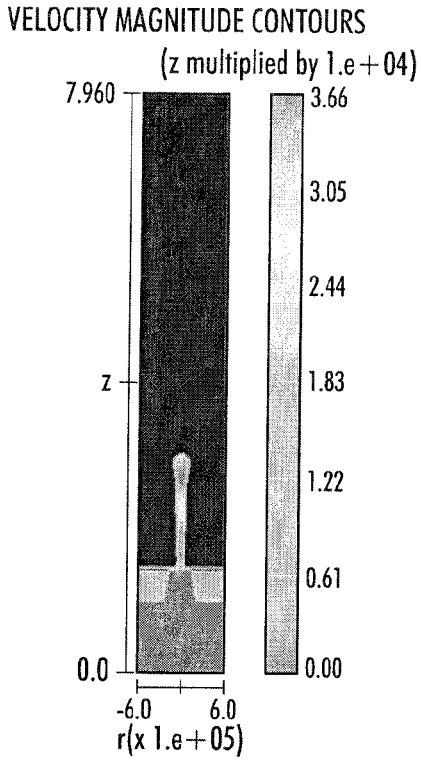
FIG. 5*a* is a graph depicting the speed of an ink drop ejecting from a tapered nozzle according to the present teachings.
Figure 5B:
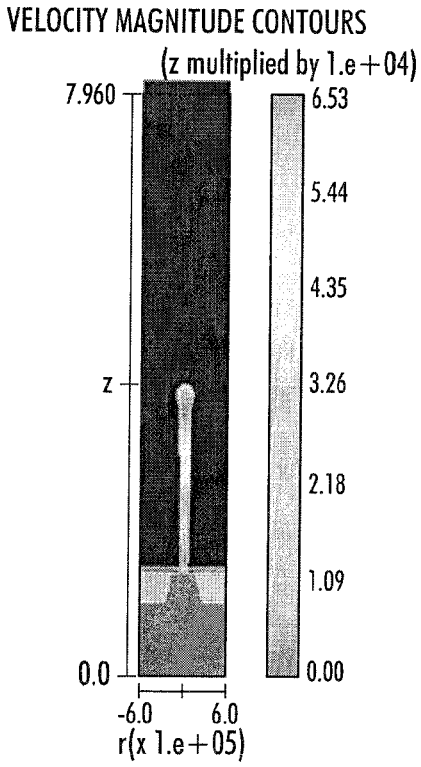
FIG. 5*b* is a graph depicting the speed of an ink drop ejecting from a tapered nozzle according to the present teachings.
Figure 5C:
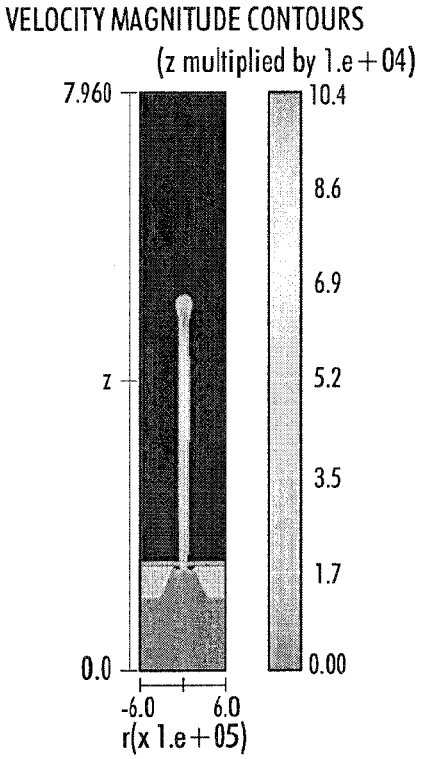
FIG. 5*c* is a graph depicting the speed of an ink drop ejecting from a tapered nozzle according to the present teachings.
Figure 5D:
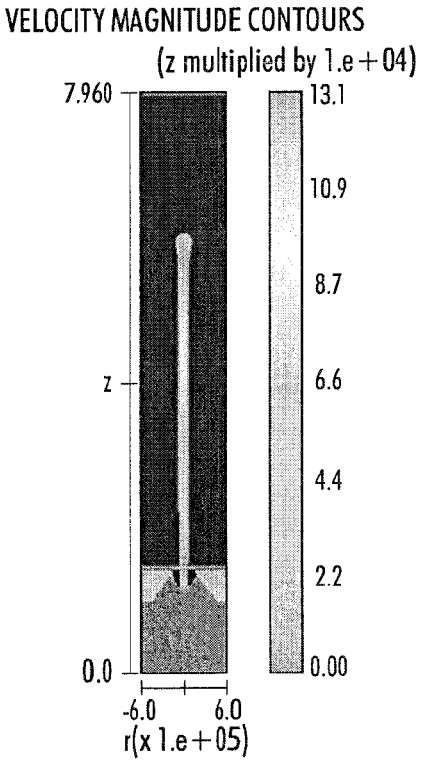
FIG. 5*d* is a graph depicting the speed of an ink drop ejecting from a tapered nozzle according to the present teachings.

FIGS. 4*a* and 4*b* are graphs depicting the mass and speed of an ink drop after ejecting from a cylindrical (non-tapered) nozzle. The results depicted in FIGS. 4*a* and 4*b* were obtained when a 53 Volt amplitude waveform was applied to a piezo inkjet actuator. The ejecting drops were modeled using a commercially available computational fluid dynamics (CFD) code, Flow3D Two test cases, (a) and (b), as respectively depicted in FIG. 4*a* and FIG. 4*b*, were conducted. Test case (a) utilized a 32 μm diameter cylindrical nozzle, and test case (b) utilized a 40 μm diameter cylindrical nozzle. In both test cases, the length of the cylindrical nozzle was 40 μm. The vertical scale bars in both test cases depict the speed of the ejected drop after passage through the respective cylindrical nozzle.

In test case (a), after passage through the cylindrical nozzle, the ejected drop had a speed of 2.5 m/s. Further, the mass of the ejected drop in test case (a) was 11.8 pL. In test case (b), after passage through the cylindrical nozzle, the ejected drop had a speed of 4.5 m/s. Further, the mass of the ejected drop in test case (b) was 22.8 pL. As such, the 40 μm diameter nozzle (test case (b)) ejected a drop larger and faster than the drop ejected by the 32 μm diameter nozzle (test case (a)) As such, the test cases (a) and (b) show that both drop mass and drop speed are dependent values upon the diameter of the utilized cylindrical nozzle.

FIGS. 5*a*-5*d* are graphs depicting the speed of an ink drop ejecting from a tapered nozzle. The results presented in FIGS. 5*a*-5*d* were obtained when a 53 Volt amplitude waveform was applied to a piezo inkjet actuator. The ejecting drops were modeled using the commercially available CFD code, Flow3D. Four test cases, (a)-(d), as respectively depicted in FIGS. 5*a*-5*d*, were conducted, and which all utilized a tapered nozzle, similar to the tapered nozzle as depicted in FIG. 3, having an exit diameter of 32 μm. Test case (a) utilized a taper angle of 9°, test case (b) utilized a taper angle of 15°, test case (c) utilized a taper angle of 25°, and test case (d) utilized a taper angle of 35°. In all test cases (a)-(d), the length of the tapered nozzle was 40 μm. The vertical scale bars in all test cases depict the speed of the ejected drop after passage through the tapered nozzle with respective taper angle.

As shown in test cases (a)-(d), the drop speed increased as the taper angle increased. For example, the drop speed in test case (d) with a taper angle of 35° is greater than the drop speed in test case (c) with a taper angle of 25°, which is greater than the drop speed in test case (b) with a taper angle of 15°, which is greater than the drop speed in test case (a) with a taper angle of 9°. As such, the test cases (a)-(d) indicated that the speed of an ejecting drop was increased as the taper angle of the respective tapered nozzle was increased.

Figure 6:
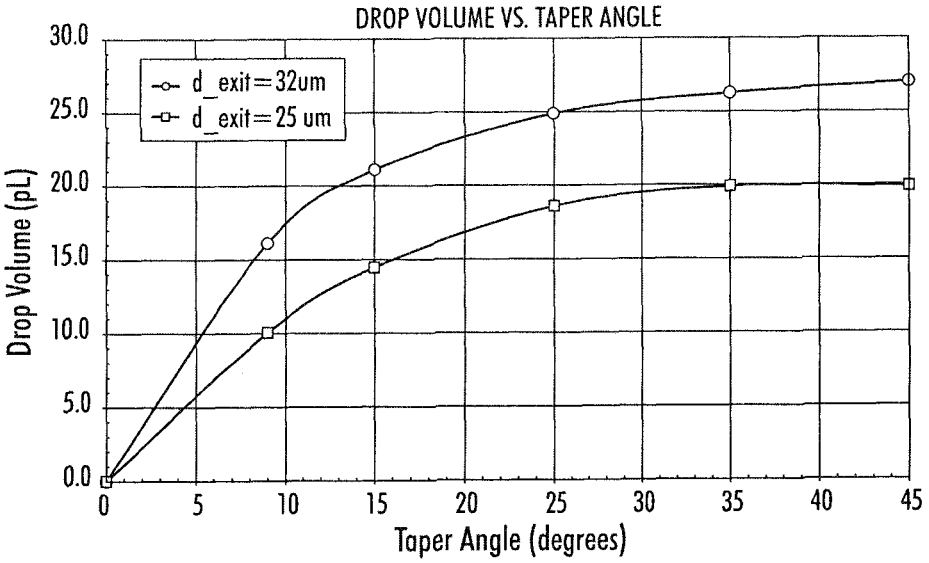
FIG. 6 is a graph depicting the mass of an ink drop ejecting from a tapered nozzle according to the present teachings as a function of the taper angle for two exit diameters.

FIG. 6 is a graph depicting the mass of an ink drop ejecting from a tapered nozzle as a function of the taper angle for two exit diameters. The results shown in FIG. 6 were obtained when a 53 Volt amplitude waveform was applied to a piezo inkjet actuator. The two curves in FIG. 6 correspond to two nozzle exit diameters, namely, the test case depicted by the curve with square (a) points, and the test case depicted by the curve with circle (o) points. The test case depicted by the line with the square points utilized a nozzle with an exit diameter of 25 μm and the test case depicted by the line with the circle points utilized a nozzle with an exit diameter of 32 μm.

The horizontal axis in FIG. 6 depicts the taper angle, in degrees, of the nozzle utilized in the respective test cases. The vertical axis in FIG. 6 depicts the volume, in pL, of the drop ejected from the nozzle utilized in the respective test cases as a function of the taper angle. As shown in FIG. 6, the drop volume of the ejected drops in both test cases increased a considerable amount for taper angles from about 0° to about 15°. Conversely, the drop volume of the ejected drops in both test cases did not change much when the taper angle was increased for taper angles of about 150 or more, in relation to the test cases in which the taper angles were less than 15°.

For example, in the test case with the nozzle exit diameter of 25 μm, the drop volume increased by about 14.0 pL when the taper angle was increased from 0° to 15°, yet increased by only about 6.0 pL when the taper angle was increased from 15° to 45°. For further example, in the test case with the nozzle exit diameter of 32 μm, the drop volume increased by about 21.0 pL when the taper angle was increased from 0° to 15°, yet increased by only about 6.0 pL when the taper angle was increased from 15° to 45°. However, the test case with the nozzle exit diameter of 32 μm overall produced larger drop volumes than did the test case with the nozzle exit diameter of 25 μm. As such, both of the test cases of FIG. 6 indicated that for taper angles of about 15° or more, the volume or mass of the ejected ink drop did not change much as the taper angle increased. Instead, the volume or mass of the ejected drop mostly depended on the size of the exit diameter.

Figure 7:
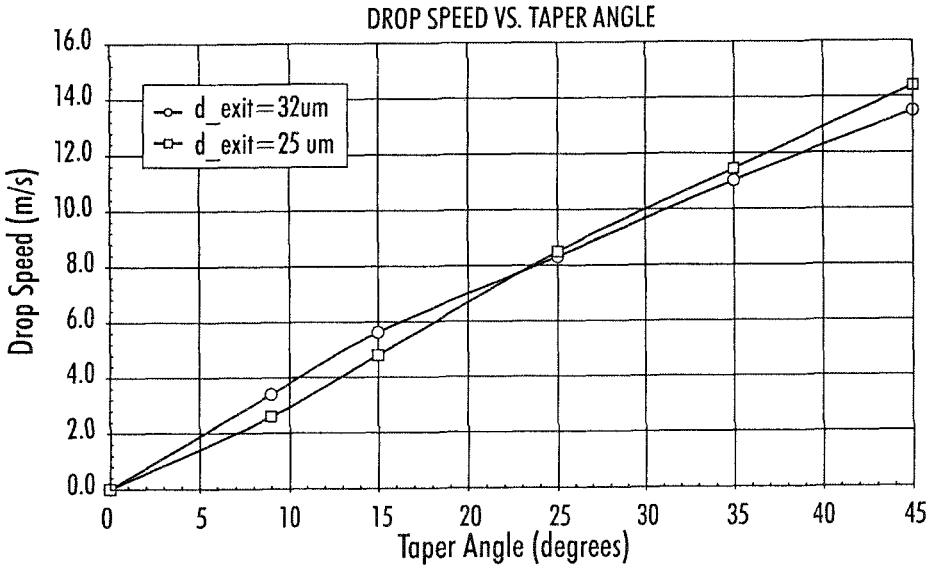
FIG. 7 is a graph depicting the speed of an ink drop ejecting from a tapered nozzle according to the present teachings as a function of the taper angle for two exit diameters.

FIG. 7 is a graph depicting the speed of an ink drop ejecting from a tapered nozzle as a function of the taper angle for the two exit diameters referenced herein. The measurements contained in FIG. 7 were obtained when a 53 Volt amplitude waveform was applied to a piezo inkjet actuator. FIG. 7 depicts two test cases, namely, the test case depicted by the Fine with square (□) points, and the test case depicted by the line with circle (○) points. The test case depicted by the line with the square points utilized a nozzle with an exit diameter of 25 μm and the test case depicted by the line with the circle points utilized a nozzle with an exit diameter of 32 μm.

The horizontal axis in FIG. 7 depicts the taper angle, in degrees, of the nozzle utilized in the respective test cases. The vertical axis in FIG. 7 depicts the drop speed, in m/s, of the drop ejected from the nozzle utilized in the respective test cases as a function of the taper angle. As shown in FIG. 7, the drop speed of the ejected drops in both test cases increased in a roughly linear fashion as the taper angles increased from 0° to 45°. Further, FIG. 7 shows that the drop speed was mostly dependent on the taper angle, and not on the size of the exit diameter. For example, the drop speed in the test case with the nozzle exit diameter of 25 μm increased in a roughly linear fashion from about 0 m/s to 14.4 m/s when the taper angle was increased from 0° to 45°. For further example, the drop speed in the test case with the nozzle exit diameter of 32 μm also increased in a roughly fashion from about 0 m/s to about 13.8 m/s when the taper angle was increased from 0° to 45°.

As such, both of the test cases of FIG. 7 indicated that the speed of the ejected ink drop could be controlled in a linear fashion by taper angles in the range of 0° to 45°. Further, the combination of the results depicted in FIGS. 6 and 7 indicated that tapered nozzles with taper angles of about 15° or more can be use to separate the adjustment in the mass and speed of the ejected drops. For example, the nozzle exit diameter can be adjusted so as to achieve the desired drop mass whereas the taper angle of the tapered nozzle can be adjusted to achieve the desired drop speed.

While the invention has been illustrated with respect to one or more exemplary embodiments, alterations and/or modifications can be made to the illustrated examples without departing from the spirit and scope of the appended claims. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items, such as, for example, "one or more of A and B," means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for forming a printhead nozzle, comprising:

selecting a desired volume of an ink drop to be ejected from the printhead nozzle;

selecting a desired drop speed for the ink drop to be ejected from the printhead nozzle;

designing the printhead nozzle to include a taper that extends from an inside opening at an inside surface of a cover plate to an exit opening at an outside surface of the cover plate;

selecting a diameter of the exit opening between about 10 μm to about 40 μm to correspond to the selected ink drop volumes;

selecting an angle of the taper of the nozzle between about 15° and 45° to correspond to the selected drop speed for the ink drop; and forming the nozzle within the cover plate, wherein the drop speed for the ink drop ejected from the printhead nozzle increases linearly from about 0 m/s to about 15 m/s as the taper angle increases from 15° up to 45° and the exit diameter is selected to be between about 10 μm to about 40 μm, and wherein the the volume of the ink drop increases by 6 pL or less when the taper angle increases from 15° up to 45° and the exit diameter is selected to be between about 10 μm to about 40 μm.

2. The method of claim 1, further comprising:

receiving ink from an ink supply via at least one ink carrying channel.

3. The method of claim 1, wherein the selecting of the angle of the taper further comprises selecting the angle of the taper having a value that is based on a difference between the exit diameter and an inside diameter of the at least one tapered nozzle.

4. The method of claim 1, further comprising setting the angle of the taper at least partially on a thickness of the cover plate.

5. The method of claim 1, further comprising applying a voltage to an actuator of the at least one tapered nozzle to eject the ink drop.

6. The method of claim 1, wherein the angle of the taper is between 25° and 35° .

7. The method of claim 6, wherein the selected drop speed is 5 m/s or greater.

8. The method of claim 7, wherein the selected drop speed is between 5 m/s and 15m/s.

* * * * *